United States Patent [19]

Goi

[11] 4,436,300

[45] Mar. 13, 1984

[54] PAPER SHEET STRIPPER DEVICE

[75] Inventor: Kouichi Goi, Tokyo, Japan

[73] Assignee: Laurel Bank Machine Co., Ltd., Tokyo, Japan

[21] Appl. No.: 298,618

[22] Filed: Sep. 2, 1981

[30] Foreign Application Priority Data

Sep. 4, 1980 [JP] Japan ..... 55-122639

[51] Int. Cl.[3] ..... B65H 7/16; B65H 3/08

[52] U.S. Cl. ..... 271/107; 271/108; 271/11; 271/14

[58] Field of Search ..... 271/14, 99, 11, 100, 271/101, 107, 108

[56] References Cited

U.S. PATENT DOCUMENTS

| | | | |
|---|---|---|---|
| 1,668,292 | 5/1928 | Spiess | 271/108 |
| 2,663,253 | 12/1953 | Sauerman et al. | 271/14 |
| 2,973,610 | 3/1961 | Randall | 271/107 |
| 2,995,360 | 8/1961 | Simpson | 271/107 |
| 3,069,025 | 12/1962 | Winkler et al. | 271/96 |
| 3,172,655 | 3/1965 | Lenk | 271/101 |
| 4,279,412 | 7/1981 | Glatz | 271/108 |

FOREIGN PATENT DOCUMENTS

| | | | |
|---|---|---|---|
| 630881 | 11/1961 | Canada | 271/107 |
| 55-21320 | 2/1980 | Japan | 271/107 |

*Primary Examiner*—Bruce H. Stone, Jr.
*Assistant Examiner*—James E. Barlow
*Attorney, Agent, or Firm*—Fleit, Jacobson, Cohn & Price

[57] ABSTRACT

A paper sheet stripper device of the type used in a paper sheet dispenser, such as a bank note dispenser, in which sheets of paper are sucked by a suction head assembly one by one and passed to a conveyer assembly by the swinging action of the suction head assembly. The improvement proposed is the use of a vacuum source for generating a constant reduced pressure for sucking operation, instead of the conventionally used vacuum source which fluctuates between positive and negative pressures. A valve is interposed between the suction head assembly and the vacuum source so that the suction head assembly communicates with the vacuum source only when the suction head assembly is swung from a sucking position at which it engages with a lower portion of the first sheet of a bundle of paper sheets to a take-up position at which the sucked paper sheet is passed to the conveyer assembly.

5 Claims, 11 Drawing Figures

PAPER SHEET STRIPPER DEVICE

BACKGROUND OF THE INVENTION

1. Field of the Invention

This invention relates generally to a paper sheet stripper device to be used in a paper sheet dispenser, and particularly to an improvement in a suction head assembly for sucking paper sheets one by one and for passing the same to a paper sheet take-up assembly located on the way to a passage through which paper sheets are conveyed.

2. Prior Art

A typical suction head assembly of the prior art used in a bank note dispenser is shown in FIGS. 1(*a*) and 1(*b*). Firstly referring to FIG. 1(*a*), the known suction head assembly; comprises a reciprocating vacuum pump 1 and a suction head 2. The suction head 2 is pneumatically connected to the vacuum pump 1 and swingable between the position shown by the solid line and the position shown by the dot-and-dash line. The suction pressure generated in the pump 1 varies periodically as represented by the sinuous curve shown in FIG. 1(*b*). The suction head 2 is swung from the position shown by the solid line to the position shown by the dot-and-dash line, as shown in FIG. 1(*a*) when the pressure applied thereon assumes a value within the range shown by 1 in FIG. 1(*b*), whereby a lower portion of a bank note is sucked by the suction head 2 and stripped from a bundle 3 of bank notes to be allowed to engage with a take-up roller assembly 4. When the pressure applied to the suction head 2 is changed to atmospheric pressure, the sucked bank note is passed to the take-up roller assembly 4 to be conveyed by a conveyer assembly 5.

However, by the use of the known combination of suction head and pump described above, a malfunction in sucking operation frequently occurs due to fluctuation in suction pressure. Moreover, the negative suction pressure applied on the suction head 2 assumes a high enough value for sucking the bank note only during the time denoted by 1 in FIG. 1(*b*). This necessitates the suction head 2 to be swung at a precise timing. As a result, the mechanism for swinging the suction head 2 is inevitably complicated. A further disadvantage of the known suction head is that the bank note sucked thereby and moved to the take-up position facing the rollers of the take-up roller assembly 4 tends to be swept off by the air blown from the port of the suction head 2 when the pressure applied on the head 2 is increased from the minimum value. Under the disadvantageous influence of the air flow caused by the pressure change in the vicinity of the port of the suction head 2, the bank note passed to the take-up roller assembly 4 and moving to the conveyer assembly 5 is not steadily moved along the predetermined passage but often gets jammed or broken.

SUMMARY OF THE INVENTION

One object of this invention is to eliminates the aforementioned disadvantages of the paper sheet stripper device of the prior art.

Another object of this invention is to provide a paper sheet stripper device having a suction head assembly to which a constant suction pressure is supplied to facilitate reliable delivery of the paper sheet from the paper sheet stock station to the conveyer assembly.

A further object of this invention is to provide a paper sheet stripper device having a suction head assembly connected to a vacuum source supplying a constant reduced pressure, means for swinging the suction head assembly, and a valve for opening and closing the path from the vacuum source to the suction head assembly in synchronism with the swinging movement of the suction head assembly.

The paper sheet stripper device provided by this invention comprises a vacuum source for generating a constant reduced pressure, a suction head assembly pneumatically connected to the vacuum source for sucking the lower portion of the first sheet of a bundle of paper sheets, swinging means for swinging the suction head assembly from a sucking position engaging with the lower portion of the first sheet of the bundle of paper sheets to a take-up position for passing the same to a conveyer assembly, and a valve interposed between the vacuum source and the suction head assembly for selectively communicating the suction head assembly with the vacuum source only when the suction head assembly is swung from the sucking position to the take-up position.

DESCRIPTION OF THE DRAWINGS

The above and other objects and advantages of this invention will become apparent from the following description of the presently preferred embodiment with reference to the accompanying drawings, in which:

FIG. 1(*b*) is a graphical representation showing the change in pressure supplied by the vacuum source incorporated in the conventional paper sheet stripper device shown in FIG. 1(*a*);

FIG. 2(*b*) is a graphical representation showing the reduced pressure generated by the vacuum source incorporated in the device shown in FIG. 2(*a*);

FIG. 4(*b*) is a sectional view taken along line IV—IV of FIG. 4(*a*);

DESCRIPTION OF THE PREFERRED EMBODIMENT

Figure 1A:
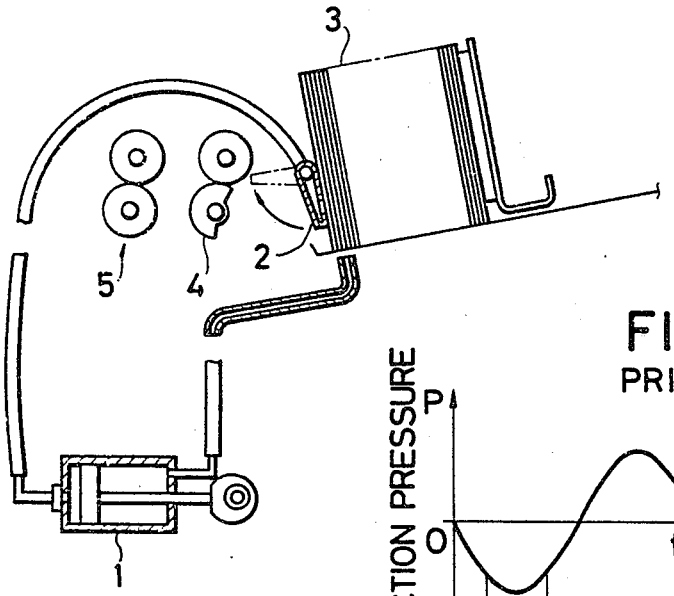
FIG. 1(a) PRIOR ART
FIG. 1(*a*) is a schematic representation of a conventional paper sheet stripper device.
Figure 1B:
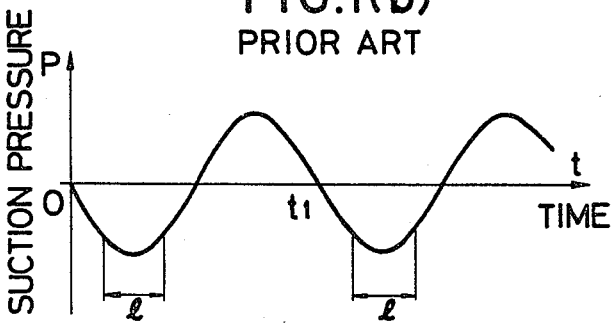
FIG. 1(b) PRIOR ART

An embodiment of the paper sheet stripper device according to this invention and the operation thereof are shown in FIG. 2 to FIG. 6. The paper sheet stripper device shown in these Figures has parts similar to those of the conventional device and such parts are denoted by the same reference numerals.

Figure 2A:
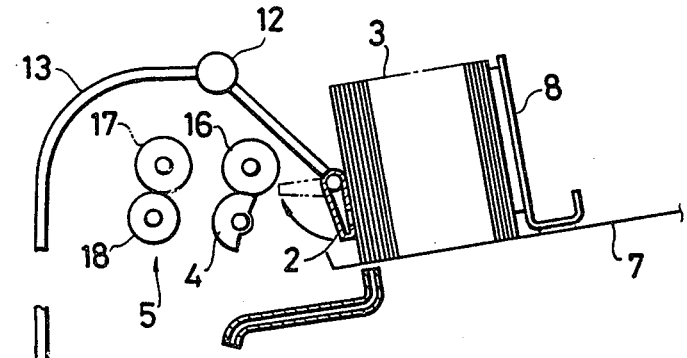
FIG. 2(*a*) is a schematic representation of an embodiment of the paper sheet stripper device according to this invention.
Figure 2B:
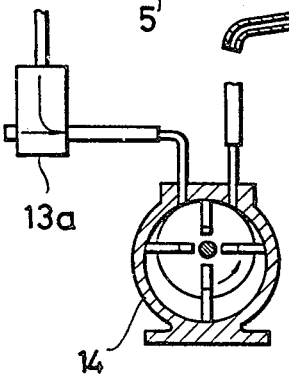
Figure 2B:
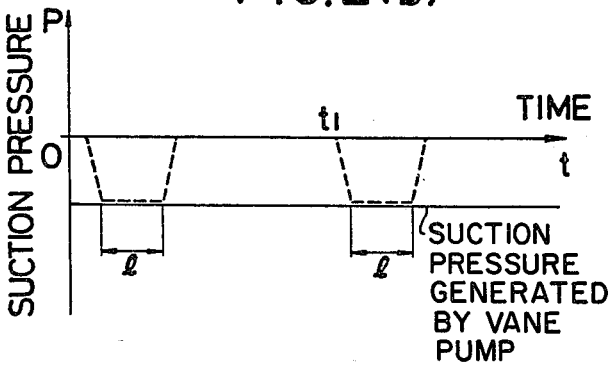
Figure 3:
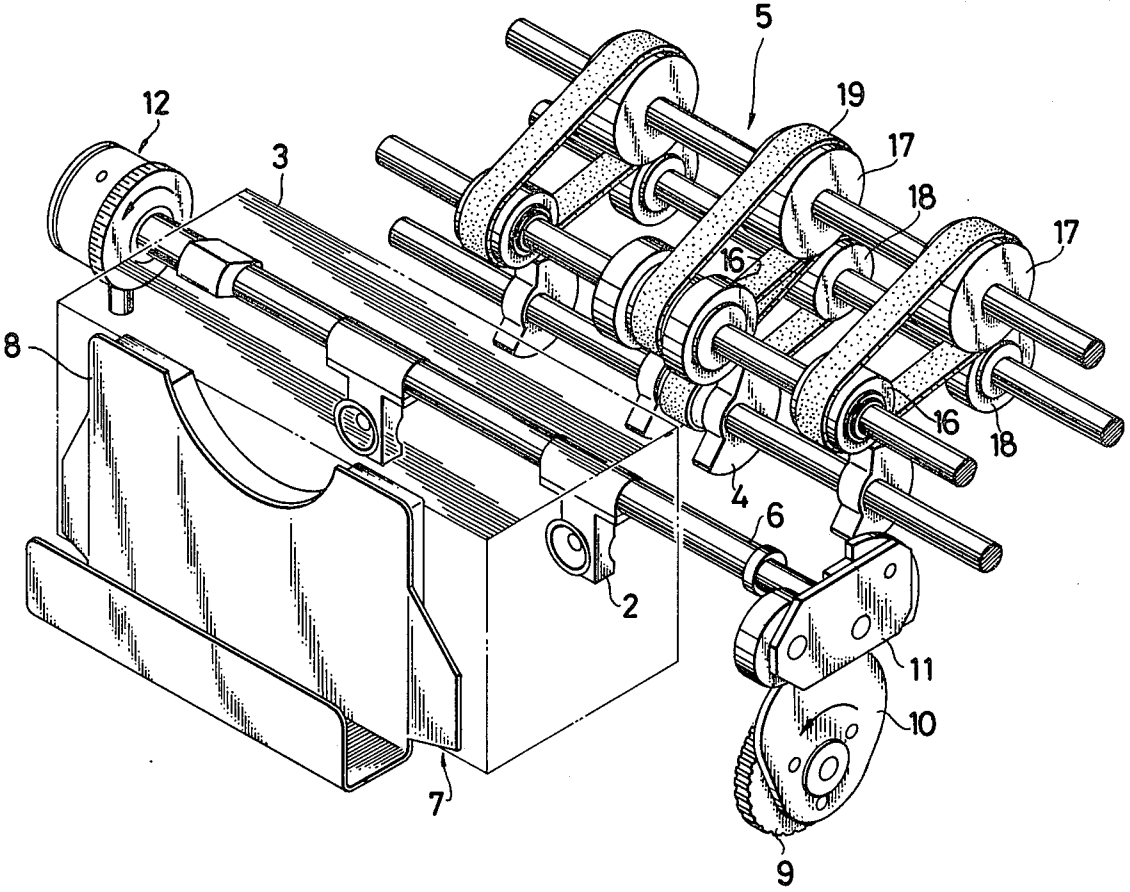
FIG. 3 is a perspective view of the paper sheet stripper device according to this invention.

Firstly referring to FIGS. 2(*a*) and 3, suction heads 2 are mounted on a hollow cylinder 6 and adapted to engage with the exposed face of the first note of a bundle 3 of bank notes held by a bank note holder 8 in a bank note container 7. The cylinder 6 is rotated from the position shown by the solid line to the position shown by the dot-and-dash line in FIG. 2(*a*) by a cam arm 11 carried at one end of the cylinder 6, when a swinging cam 10 secured to a swinging gear 9 is driven by a drive gear, not shown. At the other end of the cylinder 6, there is mounted a mechanical valve 12 which is connected through a conduit 13 and a three-way valve 13*a* to a rotary vacuum pump 14 having a plurality of vanes, that is, a vane pump. The hollow cavity of the cylinder 6 communicates through the mechanical valve 12 to the vacuum pump 14 when the mechanical valve 12 is open and the three-way valve 13*a* communicates the conduit 13 with the vacuum pump 14.

Take-up rollers 4, each having a generally semi-circular section, are disposed at positions facing the fore end of the swung suction heads 2, as shown in FIG. 2(*a*). Each of these take-up rollers 4 engages with an opposing roller 16 to take up a bank note passed from the suction heads 2. A conveyer assembly 5, including a plurality of paired rollers 17 and 18 and conveyer belts 19, is disposed in front of the take-up rollers 4 and the rollers 16 to move the bank notes along the conveying passage.

Figure 4B:
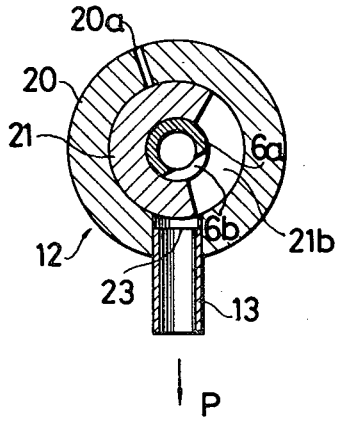
FIG. 4(*a*) is a sectional view of the mechanical valve incorporated in the paper sheet stripper device shown in FIG. 3.
Figure 4A:
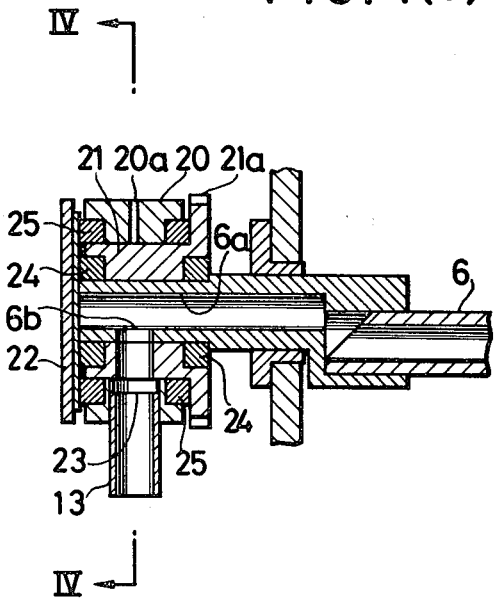

Referring to FIGS. 4(*a*) and (*b*), the mechanical valve 12 has a cylindrical valve housing 20 in which a generally annular timing member 21 is inserted. The timing member 21 has a slit 21*b* which subtends, for example, about 135° as shown in FIG. 4(*b*). An end portion 6*a* of the cylinder 6 is inserted into the timing member 21 and has a cut-out portion 6*b*. A timing gear 21*a* is integral with the timing member 21 and driven by a driving gear, not shown. The timing gear 21*a* also serves as one of the end walls of the valve housing 20, and the other end wall of the valve housing 20 is formed by a side plate 22. The valve housing 20 is provided with a communication hole 20*a*. As seen from FIG. 4(*a*), the end portion 6*a* is eccentric to the residual portion of the cylinder 6. Reference numeral 23 designates a suction port formed on the wall of the valve housing 20 to receive the end of the conduit 13, and numerals 24 and 25 designate sealing packings.

In operation of the aforementioned mechanical valve 12, the timing member 21 is rotated by one revolution per one cycle of swinging movement of the cylinder 6. The slit 21*b* of the timing member 21 communicates with the suction port 23 of the valve housing 20 during the time period when the cylinder 6 is swinging. By the use of the aforementioned mechanical valve 12, the suction heads 2 communicate with the vacuum source when they are swinging from the position shown by the solid line to the position shown by the dot-and-dash line in FIG. 2(*a*).

Figure 5A:
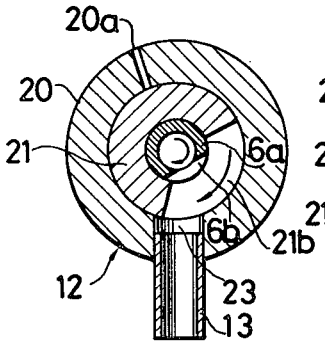
FIGS. 5(*a*) to 5(*c*) are sectional views showing three operational phases of the mechanical valve shown in FIGS. 4(*a*) and 4(*b*)
Figure 5B:
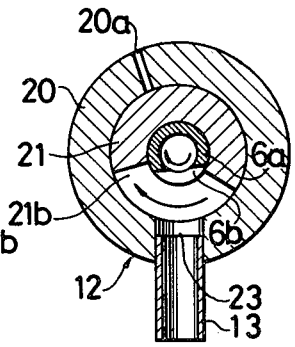
Figure 5C:
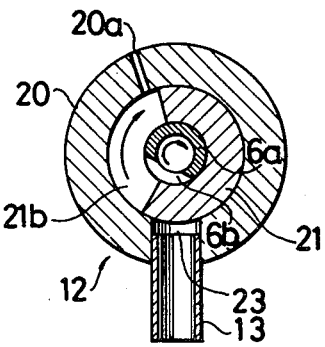
Figure 6:
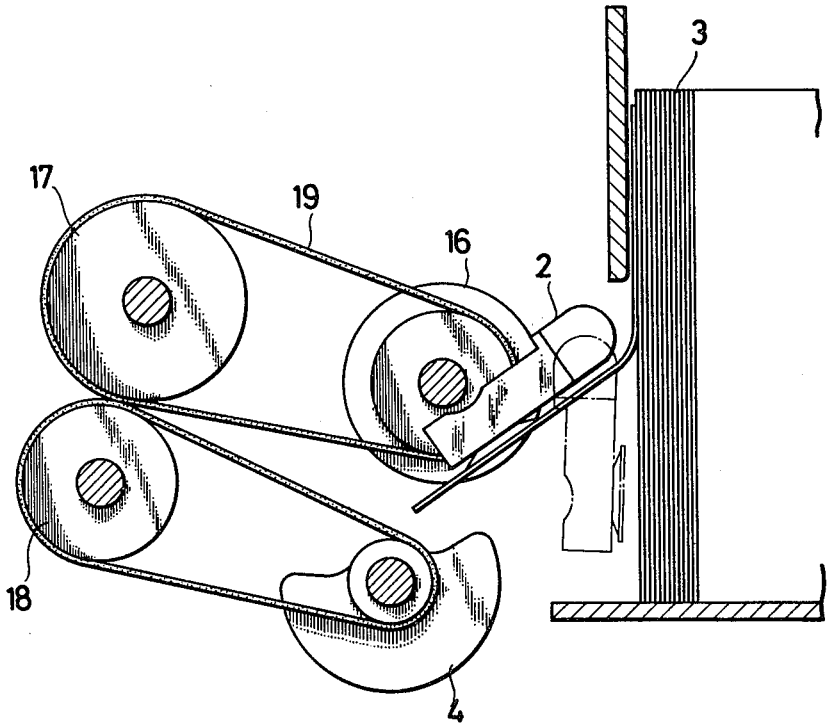
FIG. 6 is a sectional view showing, in an enlarged scale, the operation of the suction head assembly.

Referring to FIG. 5(*a*) showing the phase at which the cylinder 6 begins to swing, the slit 21*b* of the timing member 21 communicates with the suction port 23 of the valve housing 20, and also communicates with the cut-out portion 6*b* of the end 6*a* of the cylinder 6, so that the constant reduced pressure generated by the rotary pump 14 is applied to the suction heads 2. The cylinder 6 continues to swing with the cavity therein communicated with the conduit 13, as shown in FIG. 5(*b*). At the moment when the cylinder 6 reaches the position shown by the dot-and-dash line in FIG. 2(*a*), the timing member 21 closes the suction port 23, as shown in FIG. 5(*c*), to disconnect the cavity in the cylinder 6 from the conduit 13. The suction port 23 is held in the closed condition by the annular wall of the timing member 21 during the period when the timing member 21 continues to rotate until the cylinder 6 is swung back to the position shown by the solid line in FIG. 2(*a*). As will be clear from FIG. 5(*c*), when the cylinder 6 reaches the position shown by the dot-and-dash line in FIG. 2(*a*), the slit 21*b* of the timing member 21 communicates with the atmosphere through the communication hole 20*a*, whereby air is passed into the cylinder 6 through the communication hole 20*a*, the slit 21*b* and the cut-out portion 6*b* to rapidly decrease the suction pressure applied on the suction heads 2.

As shown in FIG. 2(*b*), a constant reduced pressure is generated by the rotary vane pump 14, and the suction heads 2 are communicated with the pump 14 only when they are swinging from the position shown by the solid line to the position shown by the dot-and-dash line in FIG. 2(*a*), namely the time period denoted by l, by the use of the mechanical valve 12 having the timing member 21. The suction heads 2 are maintained at atmospheric pressure at all times other than when they are swung to strip the bank note to pass the same to the take-up rollers 4.

In other words, the pressure in the suction heads 2 is reduced to reach the value equal to that generated by the rotary vane vacuum pump 14 immediately after the suction heads 2 are communicated with the conduit 13. Whereupon, the suction heads 2 suck the lower portion of the first note of the bundle 3 of bank notes, and then they are swung to the position facing the take-up rollers 4. When the suction heads 2 reach the position facing the take-up rollers 4, the timing member 21 of the mechanical valve 12 takes the position shown in FIG. 5(*c*) to communicate the suction heads 2 with the atmosphere so that the suction force by the suction heads 2 is suddenly reduced and the sucked lower portion of the bank note is smoothly released therefrom and passed to the take-up rollers 4.

As will be apparent from the foregoing, paper sheets can be stably and reliably stripped off one by one without the fear of jamming or breakage of the sheets. Although the present invention has been described by referring to a preferred embodiment thereof, it should be apparent to those skilled in the art that many modifications and changes may be made without departing from the spirit and scope thereof. For instance, although the vacuum source in the illustrated embodiment is a rotary vane pump, a vacuum tank having a sufficiently large capacity can be used in place thereof. The essential feature of the stripper device of this invention is that it includes a vacuum source which can generate substantially a constant reduced pressure when it is communicated with the sucion head assembly for sucking one end of the sheet material to strip off the same from a bundle of sheets. Further, the mechanical valve mounted on one end of the swinging cylinder for the suction head assembly in the illustrated embodiment may be replaced by a valve having a timing member rotated to open and close the path from the vacuum source to the suction head assembly in synchronism; with the swinging movement of the suction head assembly and assembled separately from the swinging cylinder for the suction head assembly. Accordingly, the foregoing description is to be construed as illustrative only, rather than limiting. This invention is limited only by the scope of the following claims.

What is claimed is:

1. A paper sheet stripper device for stripping sheets of paper one by one from a paper sheet bundle to feed the same to a conveyer assembly, comprising:

a vacuum source for generating a substantially constant reduced pressure, a suction head assembly pneumatically connected with said vacuum source for sucking a low portion of the first sheet of the paper sheet bundle, swinging means for swinging said suction head assembly from a suction position engaging with said lower portion of the first sheet of said paper sheet bundle to a take-up position for passing the paper sheets to said conveyer assembly, and a valve interposed between said vacuum source and said suction head assembly for selectively communicating said suction head assembly with said vacuum source, said valve including a circular housing in communication with said vacuum source, a hollow timing member having a slit and being rotatably received within said housing, and a hollow cylindrical shaft for carrying said suction head assembly and for providing communication therewith, an end of said cylindrical shaft being received within said timing member and having a cut-out portion, the rotation of said timing member and the swinging movement of said cylindrical shaft being in synchronism with each other so that said suction head assembly communicates with said vacuum source and is under a substantially constant reduced pressure when in the suction position, and is out of communication with said vacuum source when in the take-up position.

2. A paper sheet stripper device as claimed in claim 1, wherein said vacuum source is a rotary vacuum pump having a plurality of rotary vanes.

3. A paper sheet stripper device as claimed in claim 1, wherein said vacuum source is a vacuum tank having a sufficiently large capacity.

4. A paper sheet stripper device as claimed in claim 1, wherein said swinging means comprises a cylindrical hollow cylinder having a cavity pneumatically connecting said vacuum source to said suction head assembly and having one end carrying drive means for swinging said cylinder and the other end carrying a mechanical valve, said mechanical valve including a timing member for communicating said cavity with said vacuum source only when said cylinder is swung to move said suction head assembly from said sucking position to said take-up position.

5. A paper sheet stripper device as claimed in claim 4, wherein said timing member is a generally annular ring having a slit and rotatably mounted in the housing of said mechanical valve, said timing member being rotated to a position at which said slit communicates said vacuum source with said cavity of said hollow cylinder.

* * * * *